United States Patent [19]

Hoskins

[11] Patent Number: 4,787,553

[45] Date of Patent: Nov. 29, 1988

[54] CORNER FASTENING DEVICE

[76] Inventor: William M. Hoskins, 11 Aitken Street, Berri, South Australia, Australia

[21] Appl. No.: 126,559

[22] Filed: Nov. 30, 1987

[30] Foreign Application Priority Data

Dec. 2, 1986 [AU] Australia ..... PH9283

[51] Int. Cl.[4] ..... B65D 21/02

[52] U.S. Cl. ..... 229/49; 229/915; 229/DIG. 11; 229/918; 206/503; 206/821

[58] Field of Search ..... 24/287, 288; 206/512, 206/503, 821; 229/915, 918, 919, DIG. 11, 49; 411/456, 461

[56] References Cited

U.S. PATENT DOCUMENTS

| | | | |
|---|---|---|---|
| 534,207 | 2/1895 | Edison | 206/503 |
| 958,546 | 5/1910 | Rossmeisl | 411/456 |
| 1,147,975 | 7/1915 | Ruff | 206/821 |
| 2,868,430 | 1/1959 | Hamilton | 229/915 |
| 2,987,198 | 6/1961 | Crane | 206/821 |
| 3,944,073 | 3/1976 | Downing | 206/821 |
| 4,227,642 | 10/1980 | Ortel | 229/DIG. 11 |
| 4,592,346 | 6/1986 | Jurgutis | 411/461 |
| 4,619,365 | 10/1986 | Kelly et al. | 229/918 |
| 4,711,355 | 12/1987 | Veenman | 206/503 |

FOREIGN PATENT DOCUMENTS

| | | | |
|---|---|---|---|
| 609252 | 9/1960 | Italy | 206/821 |

*Primary Examiner*—Victor N. Sakran
*Attorney, Agent, or Firm*—Oldham & Oldham Co.

[57] ABSTRACT

A cardboard box or tray corner fastening device which includes pins to extend down into the flutes of the cardboard at a corner either across or with the line of the flutes. The pins extend from a planar support which provides a support surface for stacking further boxes or trays. A plate bears on the outside of the box near the pins to assist with retention of the pins.

9 Claims, 4 Drawing Sheets

CORNER FASTENING DEVICE

Figure 1:
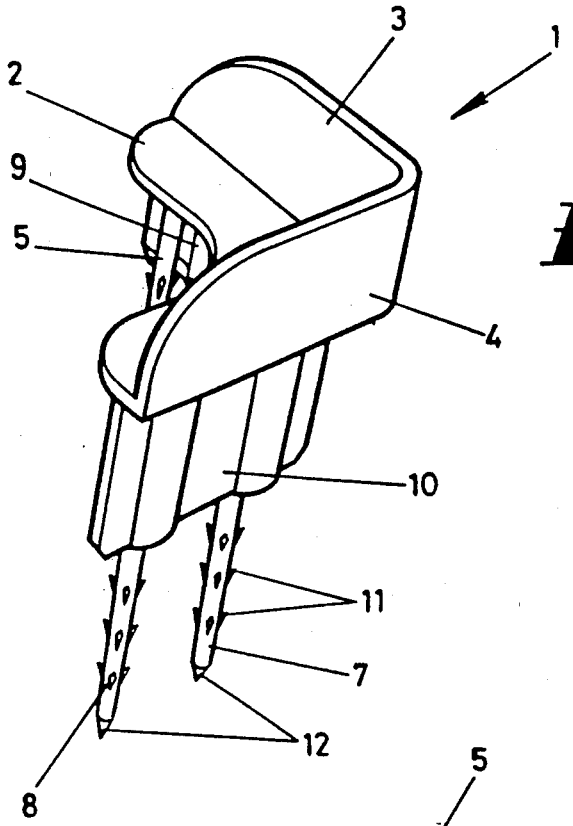

This invention relates to a corner fastening device and more particularly to a corner fastening device suitable for cardboard boxes or trays.

The type of cardboard box that this invention generally relates is that including two layers of paper or card with corrugated or fluted paper or card between the layers to provide a reinforced sheet from which a box or tray may be constructed.

In particular the corner fastening device to which the present invention is directed is useful for the manufacture of cardboard trays or boxes from cardboard box or tray blanks. There may three forms of tray produced using such blanks. A first of these may be known as a regular slotted container in which the sides of the tray have vertical flutes and the base of the tray comprises flaps extending down from edges of the sides and being folded together, make the base. A second form of tray may have a cross laminated face having two layers of corrugated cardboard glued or otherwise fastened together with the sides folded up from the base so that on all sides vertical flutes are provided. A third form of box or tray may be that having a solid base of a single thickness of corrugated cardboard with sides folded up so that two opposite sides have vertical flutes and two opposite sides have horizontal flutes.

There is proposed in Australian Patent Specification No. 537825 in the name of Metal Closures Thermo Plastics Limited a corner support for forming a right angle between a pair of panels which has two pairs of walls at right angles to each other extending from a base with a gap between the walls to enable a panel to be inserted into the gap to support the corner. Finger holes are provided in one of the walls to enable a finger to be inserted into the finger hole to push the other wall away to allow the panel to be inserted into the gap. This provides a complex operation for insertion of the corner support and may require a two handed operation.

The present invention provides an arrangement which is easier to use and simpler to insert.

It is an object of this invention therefore to provide a method and a device for the fastening of the corners of a formed cardboard tray or box of generally one of the constructions discussed above.

In one form therefore the invention is said to reside in a box or tray corner fastening and reinforcing device comprising a substantially planar base having an upper and a lower side, a plurality of pins extending from the lower side of the base and a pair of walls mutually at right angles to each other and to the planar base extending from the upper side of the base, at least one of the pins or the plurality of pins being adapted to be inserted into the flute section of two adjacent sides of a corrugated cardboard box or tray.

In a preferred embodiment there may be provided two sets of two pins each, each pair of pins being adapted to inserted into one each of the adjacent sides of the corrugated cardboard box or tray.

The base may be of the shape of a right angled triangle and the walls may be respectively positioned and along the two sides forming the right angle.

There may be further included plates extending down from the lower side of the base in the region of the pins and being substantially parallel to the pins, the plates being adapted to bear on the outside surface of the respective sides of the cardboard box to assist with retaining of the device on the box or tray.

Such plates may include at least one detent each extending towards the pins to engage onto the side of the carboard box to assist with retaining of a corner fastener onto the box.

There may be further included at least one short post extending from the upper side of the base within the region bounded by the walls which post in use extend into the base of a box being stacked onto the corner fastener to assist in retaining that box and prevent it moving.

There may be two sets of two pins each with the sets of pins in two lines mutually at right angles to each other and two dentents one on each plate being between each of the pairs of pins.

The pins may include pointed ends and serrations along at least part of their length to assist in inserting and retaining the pins in the flutes.

In a further form the invention may be said to reside in a method of fastening and reinforcing the corners of a box or tray and providing a support surface for similarly dimension box or tray comprising the steps of inserting at least one pin each into the fluted sections of two adjacent sides of a corrugated cardboard box or tray, the pins being fastened to and extending from the lower side of planar base portion the upper side of the planar base portion providing a support service for further box or tray, walls being provided on the upper side to assist with positioning when retaining the box or tray on the surface.

With the three different configurations of boxes or trays as discussed earlier the device may be equally applicable. For cross laminated trays with sides having vertical flutes then the pins may extend directly into the flutes on both adjacent sides and the planar base will facilitate stacking of boxes. For the regular slotted container all the flutes are again vertical around the edge of the box and although the corners are in fact joined in a regular slotted container, they can still be reinforced using the device of the present invention and the facility for stacking provided by the use of this invention is still possible.

For the single layer base with folded up sides one of the sides presents vertical flutes and the other of the sides presents horizontal flutes and for this type of box or tray the pins of one of the sets as discusses above may be inserted into the vertical flutes and then the pins of the other of the sets at right angles to the first set of pins may be inserted into the fluted portion but across the flutes.

The length of the pins may be varied for different applications and different side heights of boxes and trays but in one preferred embodiment, for instance, with a box having a side height of 110 to 150 mm the pins may be for instance 70 to 80 mm long.

The corner fastening and reinforcing device of the present invention may be manufactured from metal or plastics materials for instance by injection moulding or die cast moulding.

This generally describes the invention but to assist with understanding of the invention reference will now be made to the accompanying drawings which show preferred embodiments of the invention.

Figure 2:
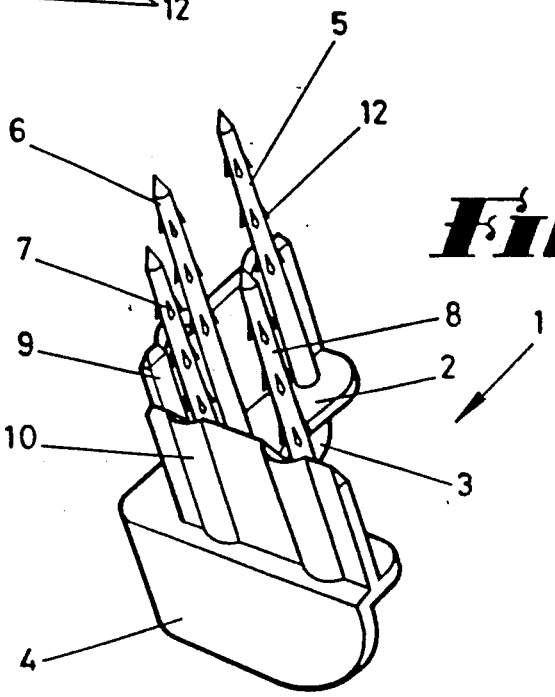
Figure 3:
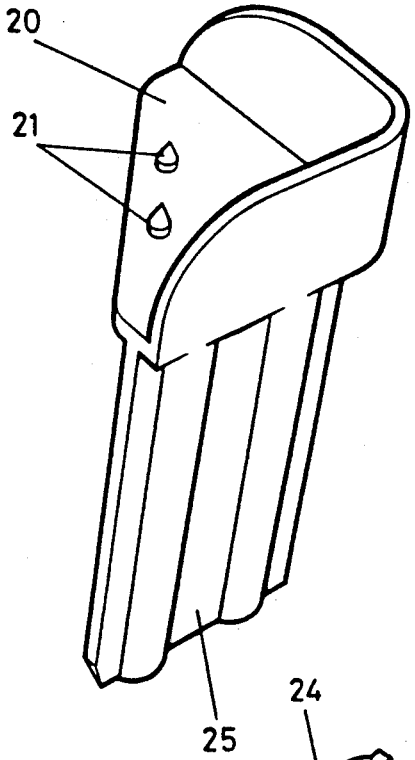
Figure 4:
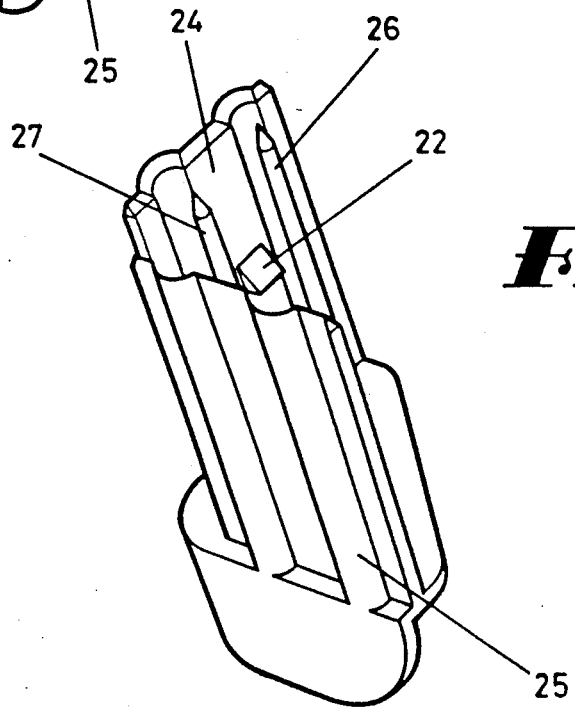
Figure 5:
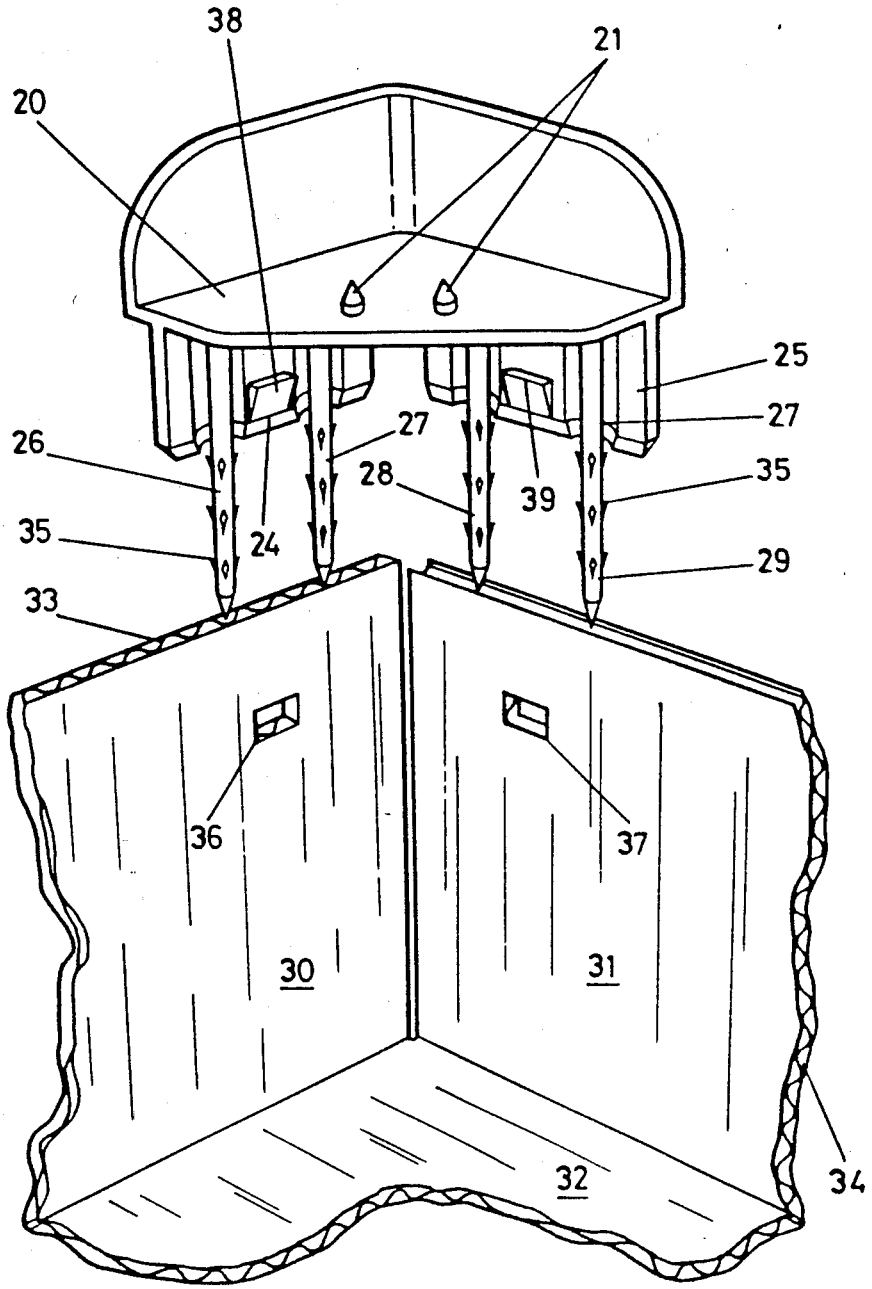
Figure 6:
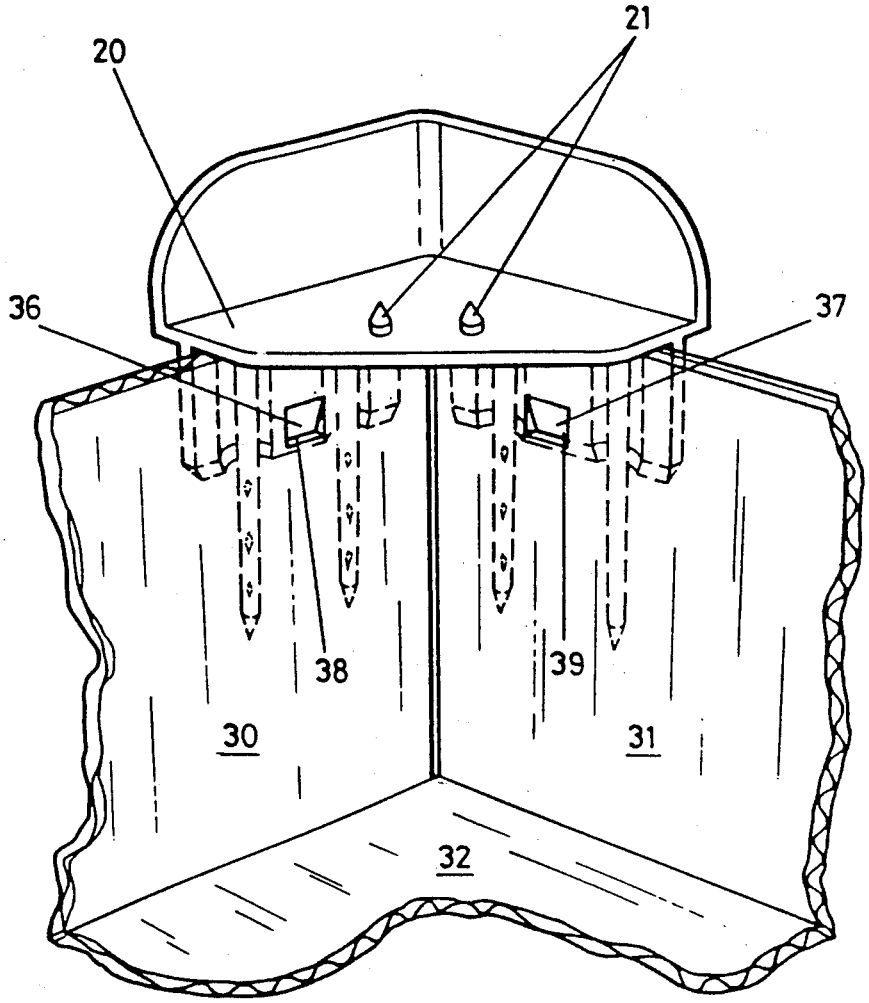

In the drawings:

FIG. 1 and FIG. 2 show perspective views of one embodiment of the present invention, FIG. 3 and FIG. 4 show a second embodiment of a corner fastening device according to the present invention, and FIG. 5 and FIG. 6 show the various stages of inserting a corner fastener into a box or tray corner.

Now looking more closely at the drawings it will be seen that in FIGS. 1 and 2 a corner fastening device 1 includes a planar base portion 2 and extending from the upper surface of the base 2 are walls 3 and 4 while extending from the lower surface are pins 5,6,7 and 8. Plates 9 and 10 also extend from the lower surface of the base 2 and run parallel to the pins. In use when the pins are inserted into the flutes or across the flutes of a corrugated cardboard edge the plates 10 bear against the outside of the corrugated cardboard sheet to assist with retaining of the pins correctly in the corrugated cardboard. The upper surface of the base portion 2 provides a support surface which when four corner support devices according to this invention are positioned on the four corners of a box provide a support surface for a further box.

By this means therefore, for instance in fruit packing a series of shallow trays each suitable for only one layer of fruit may be constructed with a next tray being supported on the corner support devices of a previous tray in the stack so that there is little chance of damage to produce in the trays by one tray sitting on the fruit of the tray immediately below.

In this embodiment the pins 5,6,7, and 8 include serrations or barbs 11 which will act to prevent removal of the pins from the flutes of a cardboard box once they are inserted. The pins are also sharpened as at 12 to facilitate insertion.

In the embodiment shown in FIGS. 3 and 4 the planar base 20 includes sharpened posts 21 which extend up from the upper surface of the planar base and are adapted to pierce the lower surface of a cardboard box stacked onto the corner support to stop the box immediately above moving in relation to the corner support and perhaps dropping of the corner support and damaging produce in the box.

In this embodiment the fins or plates 24 and 25 extend further than the pins to assist with location of the corner fastening device onto a corner of a box or tray.

There is further provided a detent 22 on plate 24 and a similar detent on plate 25 (not visible). This detent 22 is positioned between the pair of pins 26 and 27 and may either make its own hole in the corrugated cardboard of a box edge into which the pins are inserted or there may be provided an aperture on the box edge in the correct place for the detent to drop into it when the pins are fully inserted into the edge of the corrugated cardboard. The detent on plate 25 is positioned in a similar manner.

FIGS. 5 and 6 show the insertion of the corner fastening device according to FIG. 4 into two adjacent side walls 30 and 31 of a cardboard box blank having a base 32.

It will be noted that on the side 30 the pins 26 and 27 are being inserted in the same direction as the flutes 33 between the two outer layers of the cardboard box but that on the side 31 the pins 28 and 29 are being inserted at right angles to the flutes 34. The pins 26, 27, 28 and 29 are sharpened to assist with insertion across or with the flutes and include serrations 35 to assist with maintaining the pins in the flutes. Apertures 36 and 37 are provided respectively in the sides 30 and 31 so that when the corner fastening device is fully inserted onto the corners of the box blank the detent 38 is received in aperture 36 and detent 39 is received in aperture 37.

To make a more permanent box corner fastening it may also be possible to dip the pins into adhesive or apply adhesive to the pins before they are inserted into the flutes of the cardboard box to assist with retaining of the pins into the flutes. Alternatively some adhesive may be placed on the inner surface of the plates 24 and 25 to assist with retaining of the plate onto the outside surface of the box blank.

As discussed above the material of construction of the box corner reinforcing and forming members of this invention may be just injection moulding plastics or metallic material and for instance they may be manufactured from injection moulded polyethelene or polypropylene.

I claim:

1. A box or tray corner fastening and reinforcing device comprising a substantially planar base having an upper and a lower side, a plurality of pins extending from the lower side of the base and a pair of walls mutually at right angles to each other and to the planar base extending from the upper side of the base, at least two of the pins of the plurality pins being positioned and sized to be inserted into the fluted sections of two adjacent sides of a corrugated cardboard box or tray, there being two sets of two pins, each pair of pins being adapted to be inserted into one each of the adjacent sides of the corrugated cardboard box or tray.

2. A device as in claim 1 wherein the base is the shape of a right angled triangle and the walls are respectively positioned along the two sides forming the right angle.

3. A device as in claim 1 further including plates extending down from the lwoer side of the base in the region of the pins and being substantially parallel to the pins, the plates being adapted to bear onto the outside surface of respective sides of the corrugated cardboard box to assist in retaining the pins in the cardboard.

4. A device as in claim 3 wherein the plates include at least one detent extending towards the pins to engage onto the sides of the cardboard box to assist with retaining the corner fastener onto the box.

5. A device as in claim 4 wherein there are two sets of two pins each with the sets of pins in two lines mutually at right angles to each other and two detents one on each plate being between each pair of pins.

6. A device as in claim 1 further including at least one short post extending from the upper side of the base within the region bounded by the walls.

7. A device as in claim 1 wherein the pins include pointed ends and serrations along at least part of the length to assist with inserting and retaining the pins in the flutes.

8. A method of fastening and reinforcing a corner of a box or tray and providing a support surface for a similarly dimensioned box or tray comprising the steps of inserting at least one pin each into the fluted section of two adjacent sides of a corrugated cardboard box or tray, the pins being fastened to and extending from a lower side of a planar base portion, the upper side of the planar base portion providing a support surface for a further box or tray, walls being provided on the upper side of the planar base portion to assist with positioning and retaining the box or tray on the support surface.

9. A box or tray corner fastening and reinforcing device comprising a substantially planar base having an upper and a lower side, a plurality of pins having sharp ends extending from the lower side of the base and a pair of walls mutually at right angles to each other and to the planar base extending from the upper side of the base, at least two of the pins of the plurality pins being positioned and sized to be inserted into the fluted sections of two adjacent sides of a corrugated cardboard box or tray, therebeing two sets of two pins, each pair of pins being adapted to be pierced into one each of the adjacent sides of the corrugated cardboard box or tray and further including plates extending down from the lower side of the base in the region of the pins and being substantially parallel to the pins, the plates being adapted to bear onto the outside surface of respective sides of the corrugated cardboard box to assist in retaining the pins in the cardboard.

* * * * *